US008707836B2

(12) United States Patent
Yazawa et al.

(10) Patent No.: US 8,707,836 B2
(45) Date of Patent: Apr. 29, 2014

(54) MOVABLE BLADE NOT CAUSING ABRASION OF FIXED BLADE OVER LONG PERIOD OF TIME, SHEET CUTTING DEVICE PROVIDED WITH MOVABLE BLADE, AND PRINTER PROVIDED WITH SHEET CUTTING DEVICE

(75) Inventors: Shou Yazawa, Kanagawa (JP); Yukio Yoshioka, Kanagawa (JP)

(73) Assignee: NEC Infrontia Corporation, Kawasaki-Shi (JP)

( * ) Notice: Subject to any disclaimer, the term of this patent is extended or adjusted under 35 U.S.C. 154(b) by 0 days.

(21) Appl. No.: 13/991,829

(22) PCT Filed: Mar. 11, 2011

(86) PCT No.: PCT/JP2011/056494

§ 371 (c)(1),
(2), (4) Date: Jun. 5, 2013

(87) PCT Pub. No.: WO2012/077361

PCT Pub. Date: Jun. 14, 2012

(65) Prior Publication Data

US 2013/0255457 A1 Oct. 3, 2013

(30) Foreign Application Priority Data

Dec. 6, 2010 (JP) ..... 2010-271129

(51) Int. Cl.
*B26D 7/00* (2006.01)
*B26F 1/38* (2006.01)

(52) U.S. Cl.
USPC ..... 83/55; 83/821

(58) Field of Classification Search
USPC ..... 83/55, 879, 651, 623, 695, 694, 614, 83/618, 627, 629, 631, 639, 821, 856, 202, 83/563, 566, 624, 626, 628, 697; 400/621, 400/54, 593, 690; 76/101.1; 101/227
See application file for complete search history.

(56) References Cited

U.S. PATENT DOCUMENTS 3,289,497 A * 12/1966 West ..... 76/24.1
3,290,917 A * 12/1966 Don ..... 72/333
5,735,185 A * 4/1998 Kondo et al. ..... 83/611
6,152,007 A * 11/2000 Sato ..... 83/582

FOREIGN PATENT DOCUMENTS

JP 06-000797 A 1/1994
JP 2001-347485 A 12/2001
JP 2003-225887 A 8/2003

* cited by examiner

*Primary Examiner* — Ghassem Alie
(74) *Attorney, Agent, or Firm* — Sughrue Mion, PLLC

(57) ABSTRACT

A movable blade used for a sheet cutting device to be mounted to a printer for performing printing on a sheet such as roll paper and a label sheet to automatically cut to a printed sheet. The movable blade is configured to cut the printed sheet by engaging with a fixed blade . The movable blade has a pair of guide portions (22*c* ) subject to ,after punching a processing of removing a corner portion of an outer edge portion on a punching rear side (Pr).

10 Claims, 6 Drawing Sheets

MOVABLE BLADE NOT CAUSING ABRASION OF FIXED BLADE OVER LONG PERIOD OF TIME, SHEET CUTTING DEVICE PROVIDED WITH MOVABLE BLADE, AND PRINTER PROVIDED WITH SHEET CUTTING DEVICE

This application is a National Stage of International Application No. PCT/JP2011/056494, filed on Mar. 11, 2011, claiming priority from Japanese Patent Application No. 2010-271129, filed Dec. 6, 2010, the contents of all of which are incorporated herein by reference in their entirety.

TECHNICAL FIELD

This invention relates to a movable blade, which is used for a sheet cutting device to be mounted to a printer for performing printing on a sheet such as roll paper and a label sheet to automatically cut a printed sheet. The movable blade is configured to cut the printed sheet by engaging with a fixed blade.

BACKGROUND ART

A sheet cutting device of this type includes a fixed blade unit including a fixed blade and biasing means for pressurizing the fixed blade against a movable blade, and a movable blade unit including the movable blade and drive means that is connected to a drive source and drives the movable blade in a stroke direction. The fixed blade and the movable blade are opposed to each other across front and back surfaces of a sheet that has undergone printing in a sheet passage inside a printer.

The sheet cutting device including the fixed blade and the movable blade is disclosed in, for example, Related Art Document 1 of this invention (Japanese Unexamined Patent Application Publication (JP-A) 2001-347485).

Referring, as an example of the sheet cutting device, to FIGS. 1A to 1C illustrating only the fixed blade and the movable blade included in the fixed blade unit and the movable blade unit, respectively, a movable blade 72 includes a blade edge portion 72*a* that engages with a blade edge portion of a fixed blade 12, and a pair of guide portions 72*c* that protrudes toward an engagement starting end side (in the figures, upper side) with respect to the blade edge portion 72*a* at both ends of the movable blade 72 in its width direction, which corresponds to a width direction of a sheet S, the pair of guide portions 72*c* being configured to guide the engagement with the fixed blade 12 at the time of cutting. Note that, the pair of guide portions 72*c* is bent as illustrated in FIG. 1B.

This sheet cutting device operates as follows. The sheet S conveyed from the right to left of FIG. 1A is temporarily stopped, and the drive means causes the movable blade 72 to move (ascend) in a stroke direction K. The fixed blade 12 and the movable blade 72 are provided in a press-contact (engagement) state to each other by the biasing means, and hence the sheet S is cut by the principle of scissors. The cut sheet is delivered from a delivery port of the printer.

Generally, the movable blade has its outer shape formed by punching a metal plate material with use of dies.

After the punching of the outer shape, bending is carried out to form the pair of guide portions into a shape which is curved so as to increase its distance from the fixed blade as approaching the leading end (end at which engagement with the fixed blade starts) as illustrated in FIG. 1B.

At the time of punching, a movable die (not shown) is punched into the metal plate material in a direction indicated by an arrow P in FIG. 1C. In FIG. 1C, reference symbol Pf represents a punching front side, and reference symbol Pr represents a punching rear side.

By the way, after the punching of the metal plate material, as illustrated in FIG. 1C, an outer edge portion on the punching front side Pf has a shape called a shear droop, while an outer edge portion on the punching rear side Pr has a shape called a burr. Note that, in the accompanying drawings including FIG. 1C of this specification, for the sake of easy understanding of the description, the sizes and shapes of the shear droop and the burr are illustrated in an exaggerated manner.

The blade edge portion of the movable blade is required to engage with the blade edge portion of the fixed blade, and hence an outer edge portion without the shear droop, that is, the outer edge portion on the punching rear side is used therefor.

As described above, in the movable blade which has its outer shape formed by punching, burrs are generated on the outer edge portion on the punching rear side. Those burrs are also generated on the outer edge portion of each of the pair of guide portions on the punching rear side. Therefore, along with the engagement of the movable blade with respect to the fixed blade, the burr on the outer edge portion of each of the pair of guide portions on the punching rear side, in particular, the burr of the movable blade, which extends in the stroke direction, slides on the surface of the fixed blade. Even when the movable blade 72 is engaged with the fixed blade 12 without problems in the beginning as illustrated in FIGS. 2A and 2B, along with the elapse of operating time of the sheet cutting device, abrasion of the fixed blade 12 due to the burr of the pair of guide portions 72*c* progresses. As a result, as illustrated in FIGS. 2C and 2D, the burr of the pair of guide portions 72*c* digs into the original surface of the fixed blade 12, and accordingly the movable blade 72 is shifted on the fixed blade 12 side. In this case, there is a fear that the blade edge portion 72*a* of the movable blade 72 may hit the fixed blade 12 to cause locking and damaging, which may lead to problems such as losing the ability to cut the sheet.

DISCLOSURE OF THE INVENTION

It is therefore an object of this invention to provide a movable blade which does not cause abrasion of a fixed blade over a long period of time.

It is another object of this invention to provide a sheet cutting device including the movable blade as described above.

It is another object of this invention to provide a printer including the sheet cutting device as described above.

According to an exemplary embodiment of the present invention, it is possible to obtain a movable blade, which is used for a sheet cutting device to be mounted to a printer for performing printing on a sheet to cut a printed sheet, the movable blade being configured to cut the printed sheet by engaging with a fixed blade, the movable blade including: a blade edge portion that engages with the fixed blade; and a pair of guide portions that protrudes toward an engagement starting end side with respect to the blade edge portion at both ends in a width direction of the movable blade, which corresponds to a width direction of a sheet, the pair of guide portions being configured to guide the engagement with the fixed blade at a time of cutting, the movable blade having an outer shape formed by punching a metal plate material, in which the pair of guide portions is subjected to, after the punching, a processing of removing a corner portion of an outer edge portion on a punching rear side.

The pair of guide portions may be curved so as to increase a distance thereof from the fixed blade as approaching the engagement starting end side. Further, after the punching, the processing of removing the corner portion of the outer edge portion on the punching rear side may be carried out only at a part of the outer edge portion on the punching rear side excluding a predetermined leading end region including the engagement starting end.

After the punching, the processing of removing the corner portion of the outer edge portion on the punching rear side may be carried out only at a part of the outer edge portion of each of the pair of guide portions on the punching rear side, the part being located on a widthwise inner side of the movable blade.

The outer edge portion of each of the pair of guide portions on the punching rear side may be formed into a chamfered shape by the processing of removing the corner portion. Alternatively, the outer edge portion of each of the pair of guide portions on the punching rear side may be formed into a round shape by the processing of removing the corner portion.

Further, according to an exemplary embodiment of the present invention, it is possible to obtain a sheet cutting device, including: a fixed blade; and the above-mentioned movable blade, the sheet cutting device being configured to cut a printed sheet by engaging the movable blade with the fixed blade across the printed sheet.

Still further, according to an exemplary embodiment of the present invention, it is possible to obtain a printer, including: a structure for performing printing on a sheet; and the above-mentioned sheet cutting device.

Further, according to an exemplary embodiment of the present invention, it is possible to obtain a method of manufacturing a movable blade, the method being applied to a sheet cutting device to be mounted to a printer for performing printing on a sheet to cut a printed sheet, the movable blade being configured to cut the printed sheet by engaging with a fixed blade, the movable blade including: a blade edge portion that engages with the fixed blade; and a pair of guide portions that protrudes toward an engagement starting end side with respect to the blade edge portion at both ends in a width direction of the movable blade, which corresponds to a width direction of a sheet, the pair of guide portions being configured to guide the engagement with the fixed blade at a time of cutting, the method including: punching a metal plate material to form an outer shape of the movable blade; and carrying out, after the punching, a processing of removing a corner portion of an outer edge portion of each of the pair of guide portions on a punching rear side.

After the punching, the processing of removing the corner portion of the outer edge portion on the punching rear side may be carried out only at a part of the outer edge portion on the punching rear side excluding a predetermined leading end region including the engagement starting end. Further, the method may further include bending the pair of guide portions so as to be curved to increase a distance thereof from the fixed blade as approaching the engagement starting end side.

After the punching, the processing of removing the corner portion may be carried out only at a part of the outer edge portion of each of the pair of guide portions on the punching rear side, the part being located on a widthwise inner side of the movable blade.

The processing of removing the corner portion may include forming the outer edge portion of each of the pair of guide portions on the punching rear side into a chamfered shape. Alternatively, the processing of removing the corner portion may include forming the outer edge portion of each of the pair of guide portions on the punching rear side into a round shape.

BEST MODES FOR EMBODYING THE INVENTION

A movable blade of this invention is used for a sheet cutting device to be mounted to a printer for performing printing on a sheet to cut a printed sheet. The movable blade is configured to cut the printed sheet by engaging with a fixed blade. The movable blade includes: a blade edge portion that engages with the fixed blade; and a pair of guide portions that protrudes toward an engagement starting end side with respect to the blade edge portion at both ends in a width direction of the movable blade, which corresponds to a width direction of a sheet, the pair of guide portions being configured to guide the engagement with the fixed blade at a time of cutting. An outer shape of the movable blade is formed by punching a metal plate material.

In particular, this movable blade is subjected to, after the punching, pressing for deburring at widthwise outer edge portions at widthwise both sides of each of a pair of guide portions on a punching rear side.

Note that, in a case where the pair of guide portions has a shape which is curved so as to increase its distance from the fixed blade as approaching the leading end (end at which engagement with the fixed blade starts), the pressing for deburring is unnecessary for the outer edge portion on the punching rear side in a predetermined leading end region including the engagement starting end.

In this movable blade, with the above-mentioned configuration, after the punching of the outer shape, the burrs generated on the widthwise outer edge portions at widthwise both sides of each of a pair of guide portions on the punching rear side are crushed (flattened), and a corner portion is also crushed (flattened). Therefore, abrasion of the fixed blade is not caused over a long period of time.

In the following, with reference to the drawings, a movable blade, a sheet cutting device, and a printer according to embodiments of this invention are described.

First Embodiment

A movable blade according to a first embodiment of this invention is used for a sheet cutting device to be mounted to a printer for performing printing on a sheet such as roll paper and a label sheet to automatically cut a printed sheet. The movable blade is configured to cut the printed sheet by engaging with a fixed blade.

Figure 1B:
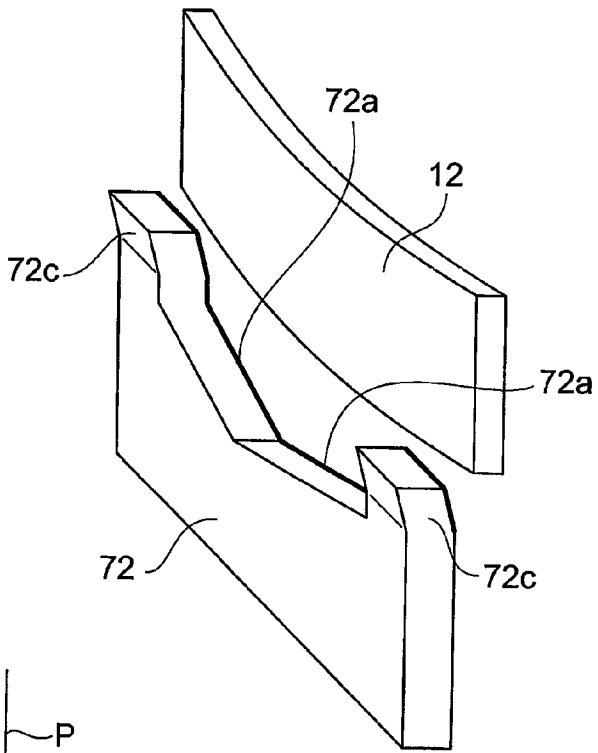
FIGS. 1A, 1B, and 1C are a sectional view illustrating a main part of a sheet cutting device including a movable blade as the related art of this invention, a perspective view illustrating the main part of the sheet cutting device, and a sectional view illustrating the movable blade, respectively.
Figure 1C:
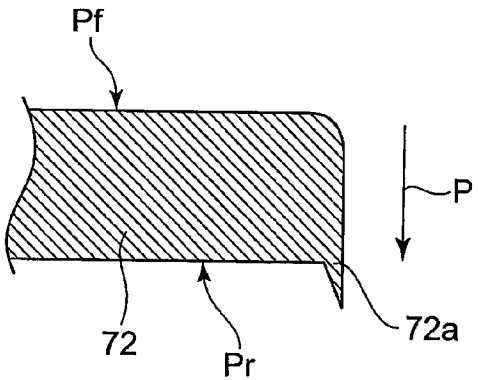
Figure 1A:
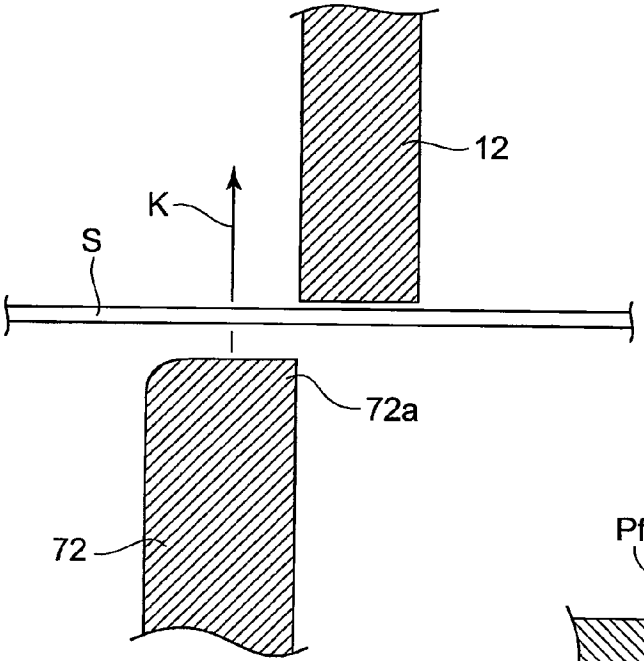
Figure 2A:
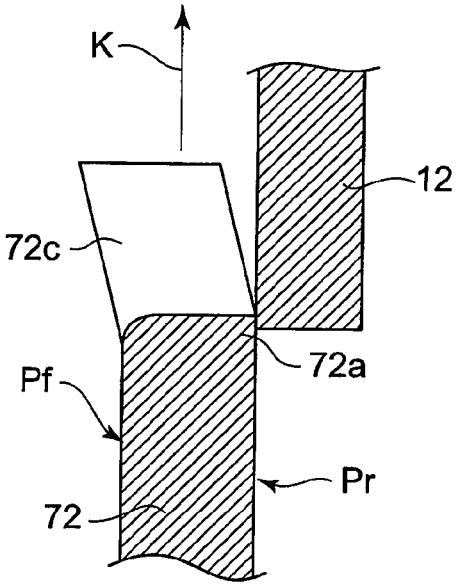
FIGS. 2A to 2D are sectional views illustrating an operation of the sheet cutting device including the movable blade as the related art of this invention.
Figure 2B:
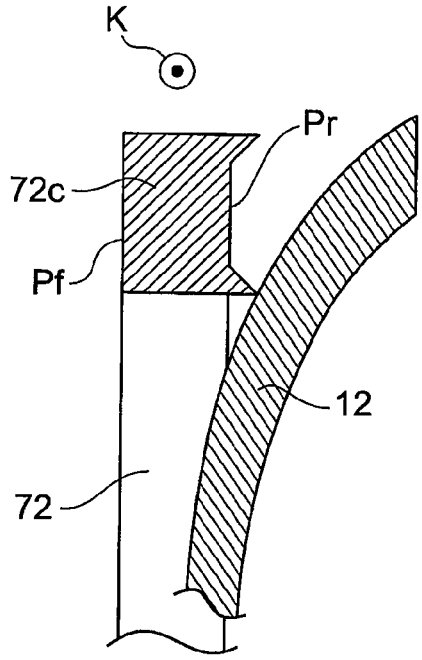
Figure 2C:
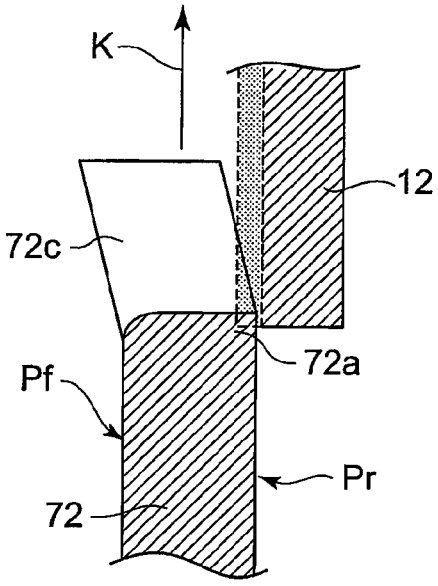
Figure 2D:
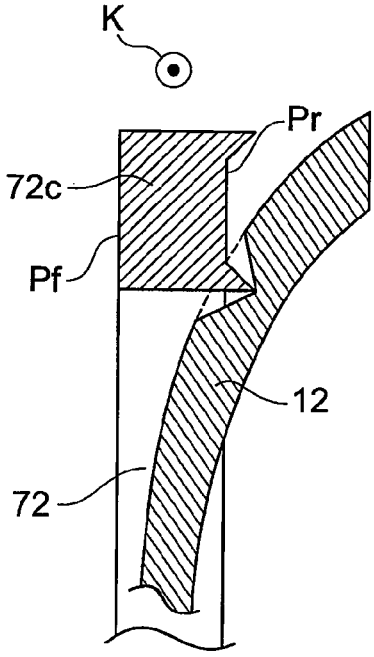
Figure 3:
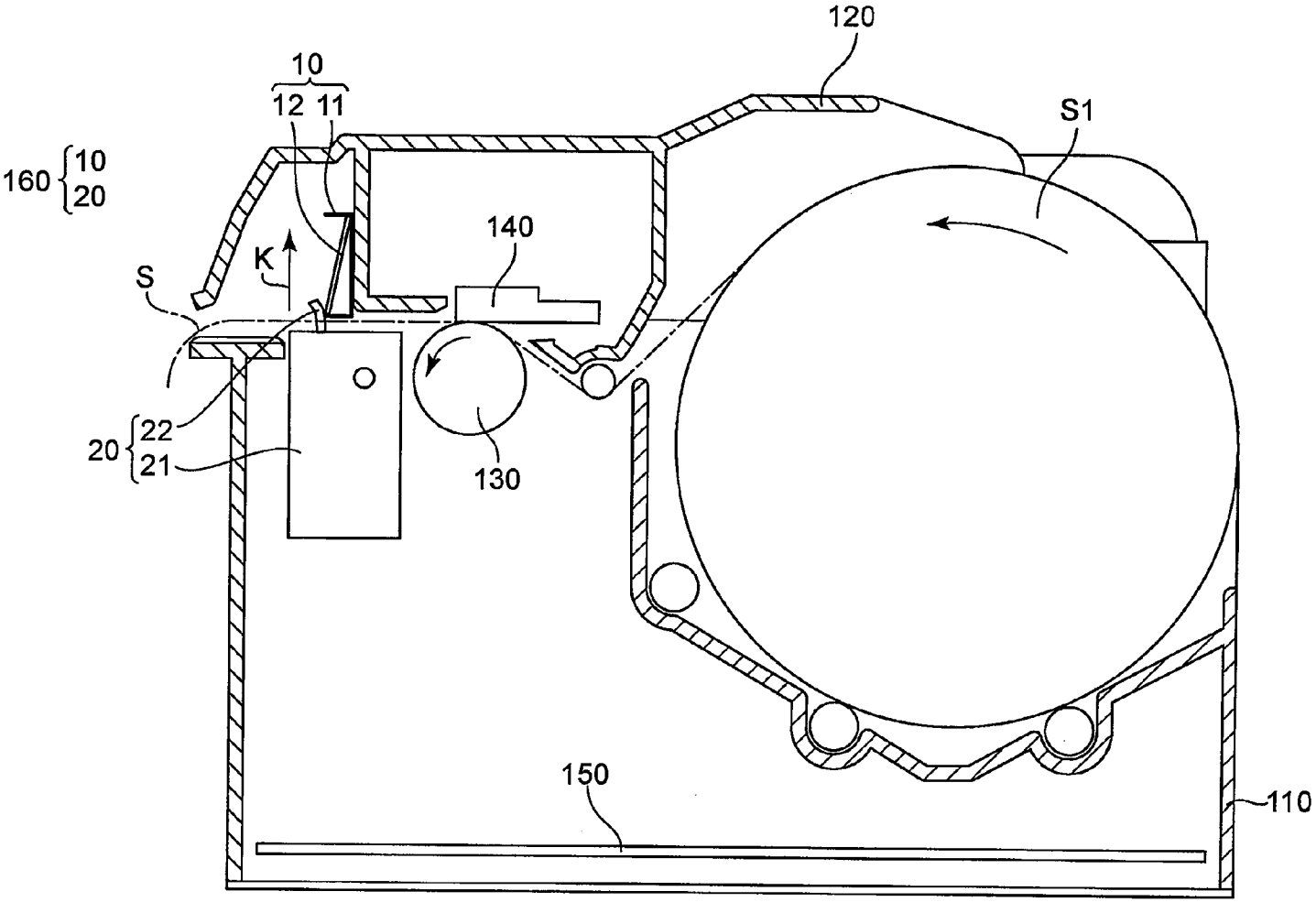
FIG. 3 is a view illustrating a printer having a sheet cutting device including a movable blade mounted thereto according to a first embodiment of this invention.

Referring to FIG. 3, a printer according to the first embodiment of this invention includes a lower frame 110 which is to be loaded with roll paper S1, an upper frame 120 for openably covering the lower frame 110, a platen 130 which is mounted to the lower frame 110 and is configured to unroll a sheet S from the roll paper S1 in the left direction of the figure, and a printing head 140 of, for example, a thermal type, for performing printing on the sheet S on a circumferential surface of the platen 130.

This printer further includes a sheet cutting device 160 for cutting the sheet S that has undergone printing, and a control board 150 which is incorporated inside the lower frame 110, for controlling the operation of this printer.

The sheet cutting device 160 includes a fixed blade unit 10 which is mounted to the upper frame 120 and includes a fixed blade 12, and a movable blade unit 20 which is mounted to the lower frame 110 below the fixed blade unit 10 so as to be opposed thereto across the sheet S that has undergone printing and includes a movable blade 22.

The fixed blade unit 10 includes a fixed blade frame 11, the fixed blade 12 supported by the fixed blade frame 11, and biasing means (not shown) for pressurizing the fixed blade 12 against the movable blade 22.

The movable blade unit 20 includes a movable blade housing 21, the movable blade 22 supported inside the movable blade housing 21 so as to be movable in a stroke direction K, a rack (not shown) mounted to the movable blade 22, and a pinion gear (not shown) which is connected to a drive source (not shown) and is configured to drive the rack and the movable blade 22 in the stroke direction K.

Figure 4B:
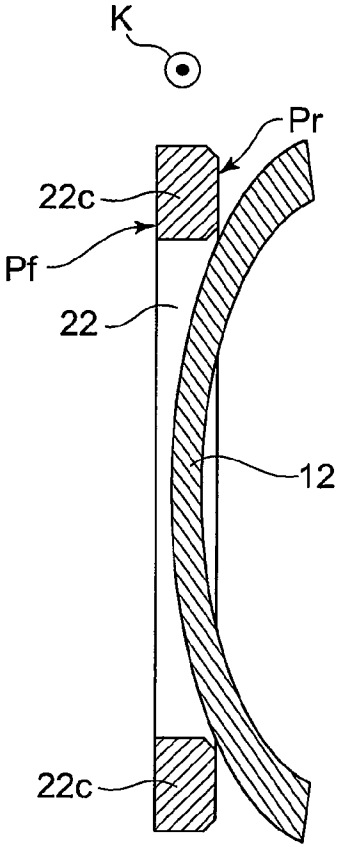
FIGS. 4A and 4B are a perspective view and a sectional view, respectively, illustrating a main part of the sheet cutting device including the movable blade according to the first embodiment of this invention.
Figure 4A:
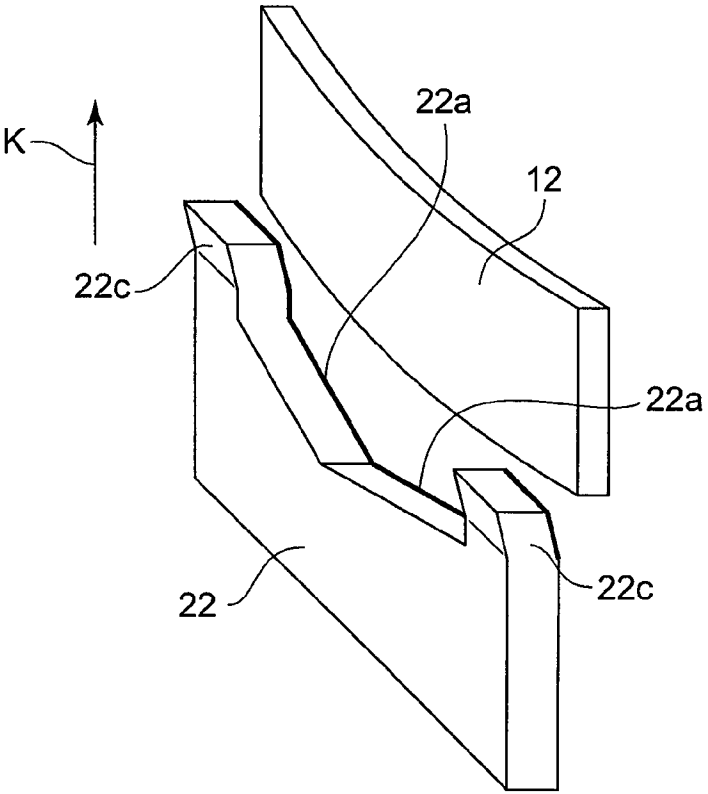

Referring to FIGS. 4A and 4B, the movable blade 22 according to the first embodiment of this invention includes a blade edge portion 22*a* and a pair of guide portions 22*c*.

The blade edge portion 22*a* exhibits a sheet cutting function by engaging with the fixed blade 12.

The pair of guide portions 22*c* protrudes toward the engagement starting end side with respect to the blade edge portion 22*a* at both ends of the movable blade 22 in its width direction, which corresponds to a width direction of the sheet S (FIG. 3), and is configured to guide the engagement with the fixed blade 12 at the time of cutting.

An outer shape of the movable blade 22 is formed by punching a metal plate material.

As is apparent from FIG. 4B, in the movable blade 22, the pair of guide portions 22*c* is subjected to, after the punching of the outer shape, pressing for deburring at an outer edge portion on a punching rear side Pr. The outer edge portion of each of the pair of guide portions 22*c* on the punching rear side Pr is formed into a chamfered shape by the pressing for deburring.

In the movable blade 22, with the above-mentioned configuration, after the punching of the outer shape, the burrs generated on the outer edge portions of each of the pair of guide portions, which are located on both widthwise sides and on the punching rear side Pr, are crushed (flattened), and the corner portions are also crushed (flattened). Therefore, abrasion of the fixed blade is not caused over a long period of time. Note that, the pair of guide portions has a shape which is curved so as to increase its distance from the fixed blade as approaching the leading end (end at which engagement with the fixed blade starts), and hence the pressing for deburring is unnecessary for the outer edge portion on the punching rear side in a predetermined leading end region including the engagement starting end.

Next, a method of manufacturing the movable blade 22 is described.

First, the metal plate material is punched to form the outer shape. Due to the punching of the outer shape, burrs are generated on the outer edge portion on the punching rear side Pr.

Subsequently, the outer edge portion of each of the pair of guide portions 22*c* on the punching rear side Pr is pressed for deburring. The outer edge portion of each of the pair of guide portions 22*c* on the punching rear side Pr is formed into a chamfered shape by the pressing for deburring. That is, the burrs generated on the outer edge portions on the punching rear side Pr are crushed (flattened), and the corner portions are also crushed (flattened). That is, the corner portions of the outer edge portions of each of the pair of guide portions, which are located on both widthwise sides and on the punching rear side, are removed.

Subsequently, by bending, the pair of guide portions 22*c* is formed into such a shape that the pair of guide portions 22*c* separates from the fixed blade 12 as approaching the leading end when being incorporated in the sheet cutting device.

As described above, the movable blade 22 according to the first embodiment of this invention is manufactured.

Second Embodiment

A second embodiment of this invention differs from the first embodiment in that the pressing for deburring is carried out only at a part of the outer edge portion of each of the pair of guide portions on the punching rear side, which is located on a widthwise inner side of the movable blade. Therefore, the same or similar parts as those in the first embodiment are denoted by the same or similar reference symbols, and detailed description thereof is omitted.

Figure 5B:
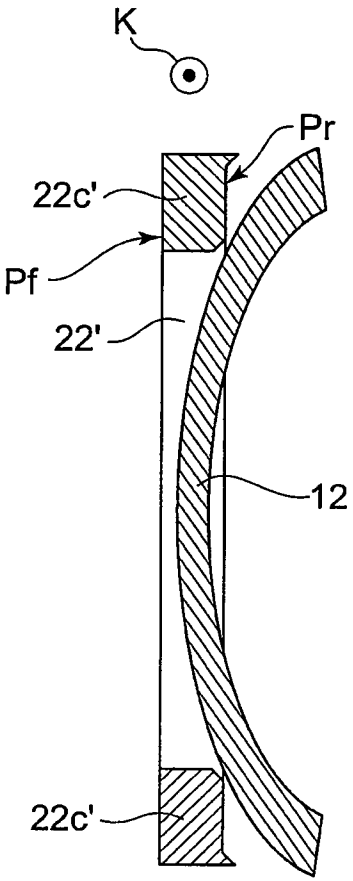
FIGS. 5A and 5B are a perspective view and a sectional view, respectively, illustrating a main part of a sheet cutting device including a movable blade according to a second embodiment of this invention.
Figure 5A:
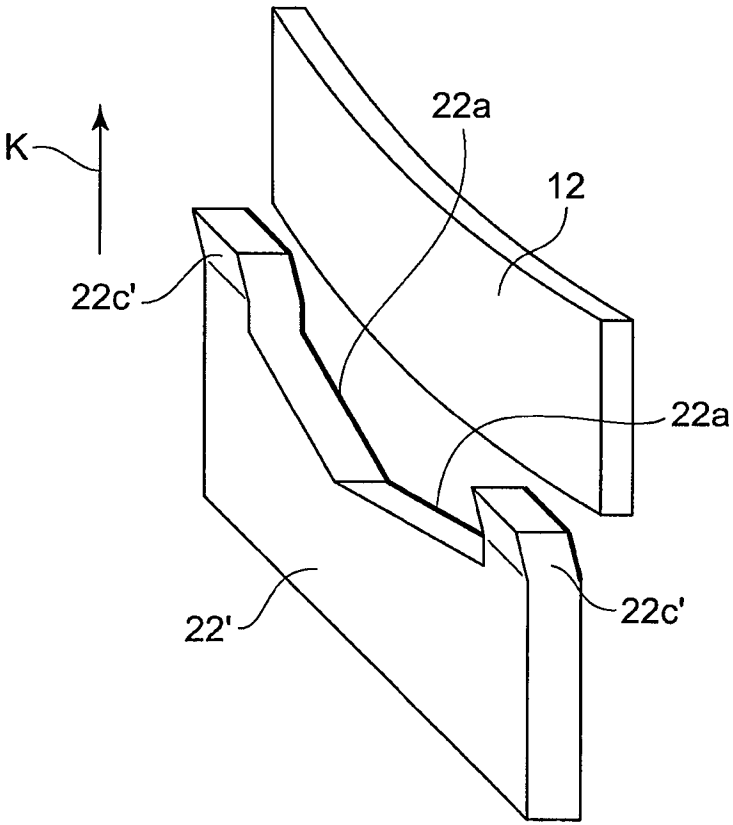

Referring to FIGS. 5A and 5B, a movable blade 22' according to the second embodiment of this invention includes, similarly to the first embodiment, the blade edge portion 22*a* and a pair of guide portions 22*c*'. The blade edge portion 22*a* exhibits a sheet cutting function by engaging with the fixed blade 12.

The pair of guide portions 22*c*' protrudes toward the engagement starting end side with respect to the blade edge portion 22*a* at both ends of the movable blade 22' in its width direction, which corresponds to the width direction of the sheet, and is configured to guide the engagement with the fixed blade 12 at the time of cutting.

An outer shape of the movable blade 22' is formed by punching a metal plate material.

As is apparent from FIG. 5B, in the movable blade 22', the pair of guide portions 22*c*' is subjected to, after the punching of the outer shape, pressing for deburring only at a part of the outer edge portion of each of the pair of guide portions on the punching rear side Pr, which is located on the widthwise inner side of the movable blade. The part of the outer edge portion of each of the pair of guide portions 22*c*' on the punching rear side Pr, which is located on the widthwise inner side of the movable blade 22', is formed into a chamfered shape by the pressing for deburring.

In this case, in order to cut the sheet in cooperation with the movable blade 22', as illustrated in FIGS. 5A and 5B, the fixed blade 12 is formed into a shape is that curved in the width direction of the fixed blade 12, which corresponds to the width direction of the sheet. Therefore, a part of the outer edge portion of each of the pair of guide portions 22*c*' on the punching rear side Pr, which is located on a widthwise outer side of the movable blade 22', is not brought into contact with the surface of the fixed blade 12, and hence there is no problem even if the burrs are generated in this part. On the other hand, the part of the outer edge portion of each of the pair of guide portions of the movable blade 22' on the punching rear side Pr, which is located on the widthwise inner side of the movable blade 22', is brought into contact with the surface of the fixed blade 12, and hence the burrs in this part are removed by the pressing for deburring, and also the corner portion is removed.

In the movable blade 22', with the above-mentioned configuration, after the punching of the outer shape, the burrs generated on the part of the outer edge portion of each of the pair of guide portions on the punching rear side Pr, which is located on the widthwise inner side of the movable blade 22', are crushed (flattened), and the corner portion is also crushed (flattened). Therefore, abrasion of the fixed blade is not caused over a long period of time. Note that, the pair of guide portions has a shape which is curved so as to increase its distance from the fixed blade as approaching the leading end (end at which engagement with the fixed blade starts), and hence the pressing for deburring is unnecessary for the outer edge portion on the punching rear side in a predetermined leading end region including the engagement starting end.

Note that, using FIG. 3 illustrating the printer of the first embodiment as a reference, in the sheet cutting device 160 of FIG. 3, the movable blade 22' according to the second embodiment can be used in place of the movable blade 22.

Next, a method of manufacturing the movable blade 22' is described.

First, the metal plate material is punched to form the outer shape. Due to the punching of the outer shape, burrs are generated on the outer edge portion on the punching rear side Pr.

Subsequently, only the part of the outer edge portion of each of the pair of guide portions 22*c*' on the punching rear side Pr, which is located on the widthwise inner side of the movable blade 22', is pressed for deburring. Thus, the part of the outer edge portion of each of the pair of guide portions 22*c*' on the punching rear side Pr, which is located on the widthwise inner side of the movable blade 22', is formed into a chamfered shape by the pressing for deburring. That is, the burrs generated on the part of the outer edge portion of each of the pair of guide portions on the punching rear side Pr, which is located on the widthwise inner side of the movable blade 22', are crushed (flattened), and the corner portion is also crushed (flattened). That is, the corner portion of the part of the outer edge portion of each of the pair of guide portions on the punching rear side, which is located on the widthwise inner side of the movable blade, is removed.

Subsequently, by bending, the pair of guide portions 22*c*' is formed into such a shape that the pair of guide portions 22*c*' separates from the fixed blade 12 as approaching the leading end when being incorporated in the sheet cutting device.

As described above, the movable blade 22' according to the second embodiment of this invention is manufactured.

Third Embodiment

A third embodiment of this invention differs from the first embodiment in that a round-shape processing is performed in the pressing for deburring. Therefore, the same or similar parts as those in the first embodiment are denoted by the same or similar reference symbols, and detailed description thereof is omitted.

Figure 6B:
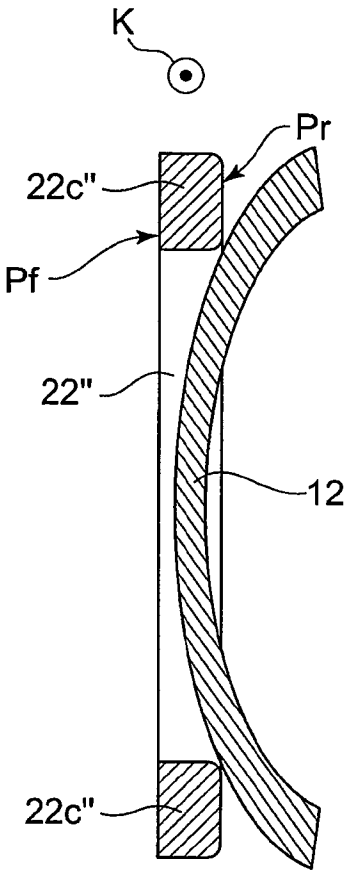
FIGS. 6A and 6B are a perspective view and a sectional view, respectively, illustrating a main part of a sheet cutting device including a movable blade according to a third embodiment of this invention.
Figure 6A:
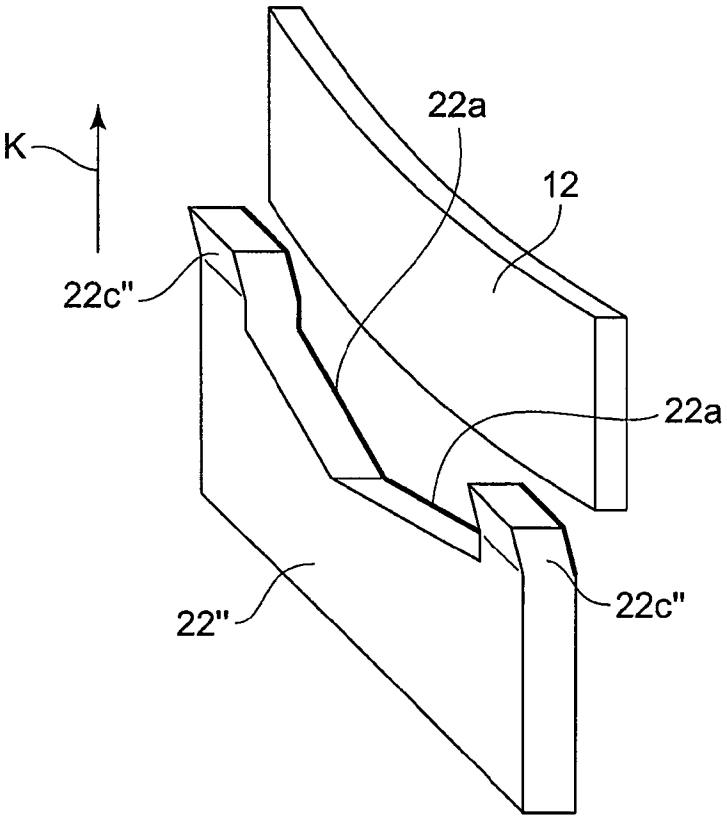

Referring to FIGS. 6A and 6B, a movable blade 22" according to the third embodiment of this invention includes, similarly to the first embodiment, the blade edge portion 22*a* and a pair of guide portions 22*c*". The blade edge portion 22*a* exhibits a sheet cutting function by engaging with the fixed blade 12.

The pair of guide portions 22*c*" protrudes toward the engagement starting end side with respect to the blade edge portion 22*a* at both ends of the movable blade 22" in its width direction, which corresponds to the width direction of the sheet, and is configured to guide the engagement with the fixed blade 12 at the time of cutting.

An outer shape of the movable blade 22" is formed by punching a metal plate material.

As is apparent from FIG. 6B, in the movable blade 22", the pair of guide portions 22*c*" is subjected to, after the punching of the outer shape, pressing for deburring at an outer edge portion on the punching rear side Pr. The outer edge portion of each of the pair of guide portions 22*c*" on the punching rear side Pr is formed into a round shape by the pressing for deburring.

In the movable blade 22", with the above-mentioned configuration, after the punching of the outer shape, the burrs generated on the outer edge portions of the pair of guide portions on the punching rear side Pr are crushed (flattened), and the corner portions are also crushed (flattened). Therefore, abrasion of the fixed blade is not caused over a long period of time. Note that, the pair of guide portions has a shape which is curved so as to increase its distance from the fixed blade as approaching the leading end (end at which engagement with the fixed blade starts), and hence the pressing for deburring is unnecessary for the outer edge portion on the punching rear side in a predetermined leading end region including the engagement starting end.

Note that, using FIG. 3 illustrating the printer of the first embodiment as a reference, in the sheet cutting device 160 of FIG. 3, the movable blade 22" according to the third embodiment can be used in place of the movable blade 22.

Next, a method of manufacturing the movable blade 22" is described.

First, the metal plate material is punched to form the outer shape. Due to the punching of the outer shape, burrs are generated on the outer edge portion on the punching rear side Pr.

Subsequently, the outer edge portion of each of the pair of guide portions 22*c*" on the punching rear side Pr is pressed for deburring. Thus, the outer edge portion of each of the pair of guide portions 22*c*" on the punching rear side Pr is formed into a round shape by the pressing for deburring. That is, the burrs generated on the outer edge portions on the punching rear side Pr are crushed (flattened), and the corner portions are also crushed (flattened). That is, the corner portions of the outer edge portions of each of the pair of guide portions, which are located on both widthwise sides and on the punching rear side, are removed.

Subsequently, by bending, the pair of guide portions 22*c*" is formed into such a shape that the pair of guide portions 22*c*" separates from the fixed blade 12 as approaching the leading end when being incorporated in the sheet cutting device.

As described above, the movable blade 22" according to the third embodiment of this invention is manufactured.

Note that, also in the above-mentioned second embodiment, similarly to the third embodiment, the round-shape processing may be performed in the pressing for deburring.

Further, in the first to third embodiments, description is made of a case where the processing of removing the corner portions on the outer edge portions of the pair of guide portions, which are located on both widthwise sides and on the punching rear side, is carried out by the pressing for deburring, but the processing of removing the corner portions may be carried out by grinding.

Note that, a part or the entire part of the embodiments described above can be described by way of notes below. However, this invention is not limited to the notes below.

[Note 1] A movable blade, which is used for a sheet cutting device to be mounted to a printer for performing printing on a sheet to cut a printed sheet, the movable blade being configured to cut the printed sheet by engaging with a fixed blade, the movable blade including: a blade edge portion that engages with the fixed blade; and a pair of guide portions that protrudes toward an engagement starting end side with respect to the blade edge portion at both ends in a width direction of the movable blade, which corresponds to a width direction of a sheet, the pair of guide portions being configured to guide the engagement with the fixed blade at a time of cutting, the movable blade having an outer shape formed by punching a metal plate material, in which the pair of guide portions is subjected to, after the punching, a processing of removing a corner portion of an outer edge portion on a punching rear side.

[Note 2] A movable blade according to the above-mentioned note, in which the pair of guide portions is curved so as to increase a distance thereof from the fixed blade as approaching the engagement starting end side, and in which, after the punching, the processing of removing the corner portion of the outer edge portion on the punching rear side is carried out only at a part of the outer edge portion on the punching rear side excluding a predetermined leading end region including the engagement starting end.

[Note 3] A movable blade according to the above-mentioned notes, in which, after the punching, the processing of removing the corner portion of the outer edge portion on the punching rear side is carried out only at a part of the outer edge portion of each of the pair of guide portions on the punching rear side, the part being located on a widthwise inner side of the movable blade.

[Note 4] A movable blade according to the above-mentioned notes, in which the outer edge portion of each of the pair of guide portions on the punching rear side is formed into a chamfered shape by the processing of removing the corner portion.

[Note 5] A movable blade according to the above-mentioned notes, in which the outer edge portion of each of the pair of guide portions on the punching rear side is formed into a round shape by the processing of removing the corner portion.

[Note 6] A sheet cutting device, including: a fixed blade; and the movable blade according to the above-mentioned notes, the sheet cutting device being configured to cut a printed sheet by engaging the movable blade with the fixed blade across the printed sheet.

[Note 7] A printer, including: a structure for performing printing on a sheet; and the sheet cutting device according to the above-mentioned note.

[Note 8] A method of manufacturing a movable blade, the method being applied to a sheet cutting device to be mounted to a printer for performing printing on a sheet to cut a printed sheet, the movable blade being configured to cut the printed sheet by engaging with a fixed blade, the movable blade including: a blade edge portion that engages with the fixed blade; and a pair of guide portions that protrudes toward an engagement starting end side with respect to the blade edge portion at both ends in a width direction of the movable blade, which corresponds to a width direction of a sheet, the pair of guide portions being configured to guide the engagement with the fixed blade at a time of cutting, the method including: punching a metal plate material to form an outer shape of the movable blade; and carrying out, after the punching, a processing of removing a corner portion of an outer edge portion of each of the pair of guide portions on a punching rear side.

[Note 9] A method of manufacturing a movable blade according to the above-mentioned note, in which, after the punching, the processing of removing the corner portion of the outer edge portion on the punching rear side is carried out only at a part of the outer edge portion on the punching rear side excluding a predetermined leading end region including the engagement starting end, and in which the method further includes bending the pair of guide portions so as to be curved to increase a distance thereof from the fixed blade as approaching the engagement starting end side.

[Note 10] A method of manufacturing a movable blade according to the above-mentioned notes, in which, after the punching, the processing of removing the corner portion is carried out only at a part of the outer edge portion of each of the pair of guide portions on the punching rear side, the part being located on a widthwise inner side of the movable blade.

[Note 11] A method of manufacturing a movable blade according to the above-mentioned notes, in which the processing of removing the corner portion includes forming the outer edge portion of each of the pair of guide portions on the punching rear side into a chamfered shape.

[Note 12] A method of manufacturing a movable blade according to the above-mentioned notes, in which the processing of removing the corner portion includes forming the outer edge portion of each of the pair of guide portions on the punching rear side into a round shape.

Industrial Applicability

This invention has been described above by means of embodiments. However, this invention is not limited to those embodiments. It should be understood that various modifications can be made thereto without departing from the technical scope described in the claims in this application.

This application is based upon and claims the benefit of priority from Japanese Patent Application No. 2010-271129, filed on Dec. 6, 2010, the entire disclosure of which is incorporated herein by reference.

The invention claimed is:

1. A movable blade, which is used for a sheet cutting device to be mounted to a printer for performing printing on a sheet to cut a printed sheet, the movable blade being configured to cut the printed sheet by engaging with a fixed blade, the movable blade comprising:

a blade edge portion that engages with the fixed blade; and a pair of guide portions that protrudes toward an engagement starting end side with respect to the blade edge portion at both ends in a width direction of the movable blade, which corresponds to a width direction of a sheet, the pair of guide portions being configured to guide the engagement with the fixed blade at a time of cutting, the movable blade having an outer shape formed by punching a metal plate material with a surface to be engaged with the fixed blade of the metal plate material directed as a punching rear side, wherein the pair of guide portions is curved so as to increase a distance thereof from the fixed blade as approaching the engagement starting end side, wherein the pair of guide portions is further subjected to, after the punching, a processing of removing a corner portion of a part of an outer edge portion on the punching rear side excluding a predetermined leading end region, the predetermined leading end region including the engagement starting end.

2. The movable blade according to claim 1, wherein the pair of guide portions is subjected to, after the punching, the processing of removing the corner portion of the outer edge portion on the punching rear side is carried out only at a part of the outer edge portion on the punching rear side excluding a predetermined leading end region including the engagement starting end.

3. The movable blade according to claim 1, wherein, after the punching, the processing of removing the corner portion of the outer edge portion on the punching rear side is carried out only at a part of the outer edge portion of each of the pair of guide portions on the punching rear side, the part being located on a widthwise inner side of the movable blade.

4. The movable blade according to claim 1, wherein the outer edge portion of each of the pair of guide portions on the punching rear side is formed into a chamfered shape by the processing of removing the corner portion.

5. The movable blade according to claim 1, wherein the outer edge portion of each of the pair of guide portions on the punching rear side is formed into a round shape by the processing of removing the corner portion.

6. The sheet cutting device, comprising:

a fixed blade; and the movable blade according to claim 1, the sheet cutting device being configured to cut a printed sheet by engaging the movable blade with the fixed blade across the printed sheet.

7. A printer, comprising:

structure for performing printing on a sheet; and the sheet cutting device according to claim 6.

8. A method of manufacturing a movable blade, the method being applied to a sheet cutting device to be mounted to a printer for performing printing on a sheet to cut a printed sheet, the movable blade being configured to cut the printed sheet by engaging with a fixed blade, the movable blade comprising:

a blade edge portion that engages with the fixed blade; and a pair of guide portions that protrudes toward an engagement starting end side with respect to the blade edge portion at both ends in a width direction of the movable blade, which corresponds to a width direction of a sheet, the pair of guide portions being configured to guide the engagement with the fixed blade at a time of cutting, the method comprising:

punching a metal plate material a metal plate material, with a surface to be engaged with the fixed blade of the metal plate material directed as a punching rear side, to form an outer shape of the movable blade; and carrying out, after the punching, a processing of removing a corner portion of a part of an outer edge portion of each of the pair of guide portions on a the punching rear side excluding a predetermined leading end region, the predetermined leading end region including the engagement starting end; and bending the pair of guide portions so as to be curved to increase a distance thereof from the fixed blade as approaching the engagement starting end side.

9. The method of manufacturing a movable blade according to claim 8, wherein, after the punching, the processing of removing the corner portion of the outer edge portion on the punching rear side is carried out only at a part of the outer edge portion of each of the pair of guide portions on the punching rear side excluding a predetermined leading end region including the engagement starting end.

10. The method of manufacturing a movable blade according to claim 8, wherein, after the punching, the processing of removing the corner portion is carried out only at a part of the outer edge portion of each of the pair of guide portions on the punching rear side, the part being located on a widthwise inner side of the movable blade.

* * * * *